US009677524B2

(12) United States Patent
Marechal et al.

(10) Patent No.: US 9,677,524 B2
(45) Date of Patent: Jun. 13, 2017

(54) HIGH PRESSURE VALVE

(71) Applicant: DELPHI INTERNATIONAL OPERATIONS LUXEMBOURG S.A.R.L., Bascharage (LU)

(72) Inventors: Michel Marechal, Chouzy sur Cisse (FR); Frederic Sauvage, Beaugency (FR)

(73) Assignee: DELPHI INTERNATIONAL OPERATIONS LUXEMBOURG S.A.R.L., Luxembourg (LU)

( * ) Notice: Subject to any disclaimer, the term of this patent is extended or adjusted under 35 U.S.C. 154(b) by 7 days.

(21) Appl. No.: 14/652,838

(22) PCT Filed: Dec. 12, 2013

(86) PCT No.: PCT/EP2013/076450
§ 371 (c)(1),
(2) Date: Sep. 29, 2015

(87) PCT Pub. No.: WO2014/095595
PCT Pub. Date: Jun. 26, 2014

(65) Prior Publication Data

US 2016/0201632 A1 Jul. 14, 2016

(30) Foreign Application Priority Data

Dec. 18, 2012 (FR) ..... 12 62266

(51) Int. Cl.
*F02M 63/00* (2006.01)
*F02M 63/02* (2006.01)

(52) U.S. Cl.
CPC .... *F02M 63/0036* (2013.01); *F02M 63/0052* (2013.01); *F02M 63/0071* (2013.01); *F02M 63/025* (2013.01)

(58) Field of Classification Search
CPC ..... F02M 63/005; F02M 63/0036; F02M 63/0052; F02M 63/023; F02M 63/0235; F02M 63/025
(Continued)

(56) References Cited

U.S. PATENT DOCUMENTS 7,441,546 B2 * 10/2008 Mitsumata ..... F02M 63/0015 123/472
7,721,712 B2 * 5/2010 Bitter ..... F02M 63/0015 123/458
(Continued)

FOREIGN PATENT DOCUMENTS

DE WO 02073029 A3 * 10/2003 ..... F02D 41/3082
DE 10 2010 043092 A1 5/2012
(Continued)

OTHER PUBLICATIONS

International Search Report dated Feb. 25, 2014.

*Primary Examiner* — Mahmoud Gimie
(74) *Attorney, Agent, or Firm* — Joshua M. Haines

(57) ABSTRACT

A nozzle able to be arranged in a diesel injection system of the internal combustion engine of a vehicle comprises a fixed member provided with a nozzle seat at the center of which there opens a discharge orifice, the fixed member comprising a cylindrical tubular part defining an inner guide cylinder extending axially from an open first end as far as the seat that forms the closed end of the guide cylinder, and a shut-off member arranged and guided in the guide cylinder, the shut-off member being able to move between a closed state (EF) when the shut-off member is in abutment against the seat and an open state (EO) when the shut-off member opens the discharge orifice.

13 Claims, 2 Drawing Sheets

(58) Field of Classification Search
USPC ..... 123/456, 457, 514, 463, 459, 458, 447, 123/461; 251/129.15, 129.02
See application file for complete search history.

(56) References Cited

U.S. PATENT DOCUMENTS

| | | | | |
|---|---|---|---|---|
| 8,291,889 | B2 * | 10/2012 | Shafer | F02M 63/025 123/458 |
| 8,826,889 | B2 * | 9/2014 | Roth | F02M 63/0015 123/458 |
| 2002/0014221 | A1 * | 2/2002 | Mori | F02M 63/005 123/447 |
| 2003/0160671 | A1 * | 8/2003 | Koch-Groeber | F02M 63/0021 335/220 |
| 2007/0034819 | A1 * | 2/2007 | Mitsumata | F02M 63/0015 251/129.14 |
| 2010/0018501 | A1 * | 1/2010 | Bitter | F02M 63/0015 123/458 |
| 2010/0269792 | A1 | 10/2010 | Roth | |
| 2011/0140016 | A1 * | 6/2011 | Roth | F02M 59/466 251/129.02 |
| 2013/0221137 | A1 | 8/2013 | Gruhl | |

FOREIGN PATENT DOCUMENTS

| | | | |
|---|---|---|---|
| EP | 1 748 240 | A1 | 1/2007 |
| EP | 2 444 652 | A2 | 4/2012 |
| FR | 2 973 092 | A1 | 9/2010 |
| WO | 2009/080426 | A1 | 7/2009 |

* cited by examiner

HIGH PRESSURE VALVE

CROSS REFERENCE TO RELATED APPLICATIONS

This application is a national stage application under 35 U.S.C. 371 of PCT Application No. PCT/EP2013/076450 having an international filing date of 12 Dec. 2013, which designated the United States, which PCT application claimed the benefit of French Patent Application number 1262266 filed on 18 Dec. 2012, the entire disclosure of each of which are hereby incorporated herein by reference.

TECHNICAL FIELD

The invention relates to a high-pressure valve for a diesel injection circuit and, more particularly, to the arrangement of these components and the manufacture thereof.

BACKGROUND OF THE INVENTION

Circuits with a direct injection of fuel into internal combustion engines comprise a controlled valve which may be engaged directly on a common rail distributing pressurized fuel to injectors. The valve is normally in a closed state and can be switched into an open state to uncover a passage and allow fuel out, thus making it possible constantly to regulate the pressure in the injection circuit.

Known amongst others are valves comprising a tubular body in which an axially mobile central shaft shuts off or uncovers the fuel outlet passage. The central shaft has a planar end in contact with the plunger of the electromagnet and a pointed or hemispheric end which collaborates with a fixed conical seat at the center of which the outlet passage opens. In normal operation the passage remains closed, the plunger of the electromagnet exerting on the central shaft a closure force that is greater than the opposite force exerted on the pointed end of the shaft by the pressurized fuel flowing along the common rail.

The mobile shaft is axially guided in a central bore of the body. In order to shut off the outlet passage, the central bore and the mobile shaft each need to have an excellent surface finish and a very small degree of non-cylindricity. The assembly should also have a small degree of non-coaxiality. In addition, given the high and repeated loads it experiences, the mobile shaft needs to be made from a high quality steel, for example a 100 Cr6 steel with quench and temper in order to obtain a surface hardness of the order of 700 HV.

This high precision machining leads to technological complexity which it has become an urgent matter to simplify by proposing valves that operate perfectly while at the same time being simple to manufacture and to assemble.

SUMMARY OF THE INVENTION

The present invention solves the abovementioned problems by proposing a valve for regulating the pressure of the fuel in the common rail of the diesel injection system of a vehicle internal combustion engine. The valve comprises a body, a shaft, an actuator and a nozzle. The nozzle itself comprises a fixed member provided with a nozzle seat in the center of which there opens a discharge orifice connecting the common rail to a discharge duct.

The shaft is arranged axially sliding in the body and is moved by the actuator in such a way as to cause the nozzle to switch between the discharge orifice being in an open state when the pressure in the common rail is above a pre-established limit, and the discharge orifice being in a closed state when the pressure in the common rail is below the pre-established limit.

Advantageously, the valve further comprises a shutoff member arranged between the shaft and the seat so that in the closed state the shaft pushes the shutoff member into abutment against the seat shutting off the discharge orifice and in the open state the pressurized fuel pushes the shutoff member back and opens the discharge orifice, the shaft itself being pushed back by the shutoff member. This form of embodiment makes it possible to uncouple the roles of the shaft, which now only pushes, and the shutoff member, the role of which is to shut off.

The fixed member of the nozzle comprises a tubular part defining an interior guide cylinder extending axially from an open first end as far as the seat forming the bottom end of the guide cylinder. The shutoff member of the nozzle is arranged and guided in the guide cylinder, the guide cylinder being in fluidic communication with the discharge duct opening onto the outside.

The tubular part of the fixed member is provided with a connecting orifice connecting the guide cylinder to the discharge duct so that when the nozzle is in the open state, the fuel emerging from the common rail passes in succession through the discharge orifice, the guide cylinder, the connecting orifice and the discharge duct.

The body is provided with a housing in which the tubular part is arranged, these between them defining an intermediate tubular space into which the discharge duct and the connecting orifice emerge. When the nozzle is in the open state the fuel emerging from the common rail passes through the intermediary tubular space before entering the discharge duct.

The fixed member of the nozzle is additionally provided with an axial cylindrical base extending between two radial surfaces so as to position the fixed member by arranging the base in a complementary counterbore, one of the two surfaces being in abutment with the end of the counterbore.

In one alternative, the counterbore is provided in the body of the valve, the fixed member of the nozzle being secured to the body.

In another alternative, the common rail comprises, amongst other things, a counterbore able to accept the nozzle, the base fitting into the counterbore, the fixed member being secured to the common rail.

The end of the shutoff member collaborating with the seat has a spherical or conical or ovoid surface, the seat for its part having a conical surface the vertex of which faces towards the rail. Alternatively, a ball is interposed between the shutoff element and the seat, the shutoff element pressing against the ball, the ball having a sufficient size that it can shut off the discharge orifice.

The actuator is the plunger of an electromagnet controlled by a central unit.

In an alternative form, the actuator is a compression spring constantly urging the shaft with an axial force rated at the pre-established pressure limit L, so that the shaft urges the nozzle towards the closed state.

Advantageously, the dimensional tolerance between the diameters of the axial bore and of the shaft is 30 μm.

Similarly, the axial bore in which the shaft is guided has a surface roughness of less than Ra 3.2.

The invention also relates to a diesel fuel injection system of the common rail type comprising a valve produced according to any one of the preceding paragraphs.

DESCRIPTION OF THE FIGURES

One embodiment of the invention is now described by way of the following figures.

DESCRIPTION OF THE PREFERRED EMBODIMENTS

Figure 1:
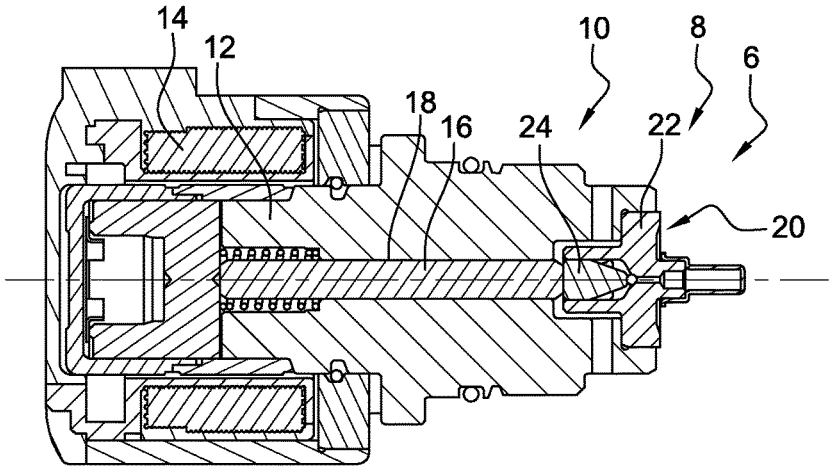
FIG. 1 is a view in axial section of a high-pressure valve according to the invention.
Figure 2:
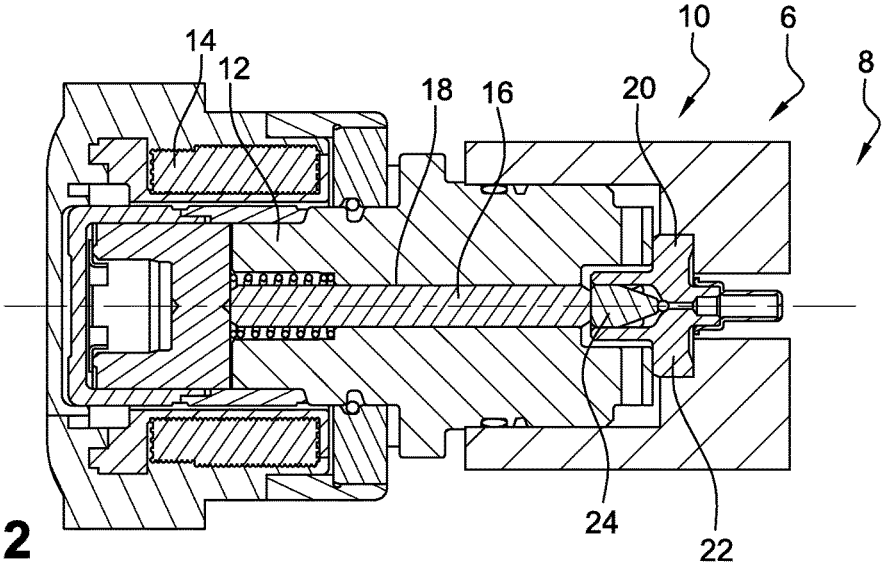
FIG. 2 is a valve produced according to a second embodiment.
Figure 3:
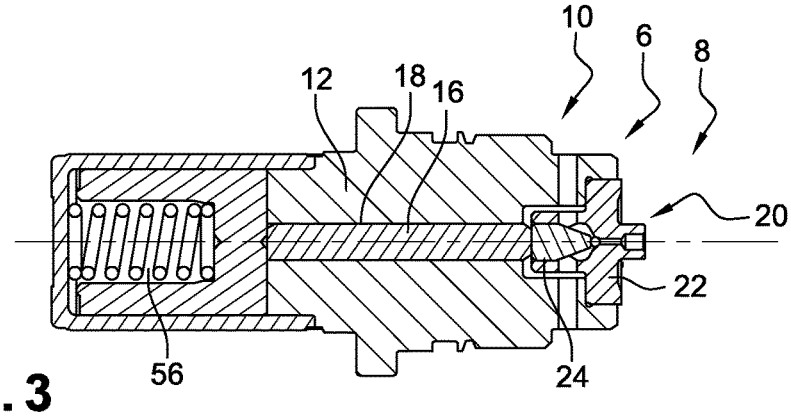
FIG. 3 is an alternative mechanical valve that can be adapted to the embodiments of FIG. 1 or 2.

FIGS. 1, 2 and 3 depict a high-pressure valve 10 intended to be mounted on the common rail 8 of the diesel injection system 6 of an internal combustion engine.

According to a preferred embodiment illustrated in FIGS. 1 and 2, the valve 10 comprises a body 12 extending along a longitudinal axis A, an electromagnet 14 of which the coil is secured to the body 12 and the plunger, able to move in the body 12, operates a shaft 16 guided axially in a central bore 18 of the body 12 between a pressed position PA and a retracted position PR. Arranged at the opposite end of the body 12 to the electromagnet 14 there is a nozzle 24 switched by the shaft 16 into an open state EO when the shaft 16 is in the retracted position PR, and into a closed state EF when the shaft 16 is in the pressed position PA. The valve 10 is fixed to the rail 8 by arranging a cylindrical surface of the body 12 in a space in the rail 8 which space is provided with a complementary female bore. A seal is placed at the interface between the body 12 and the rail 8.

Figure 4:
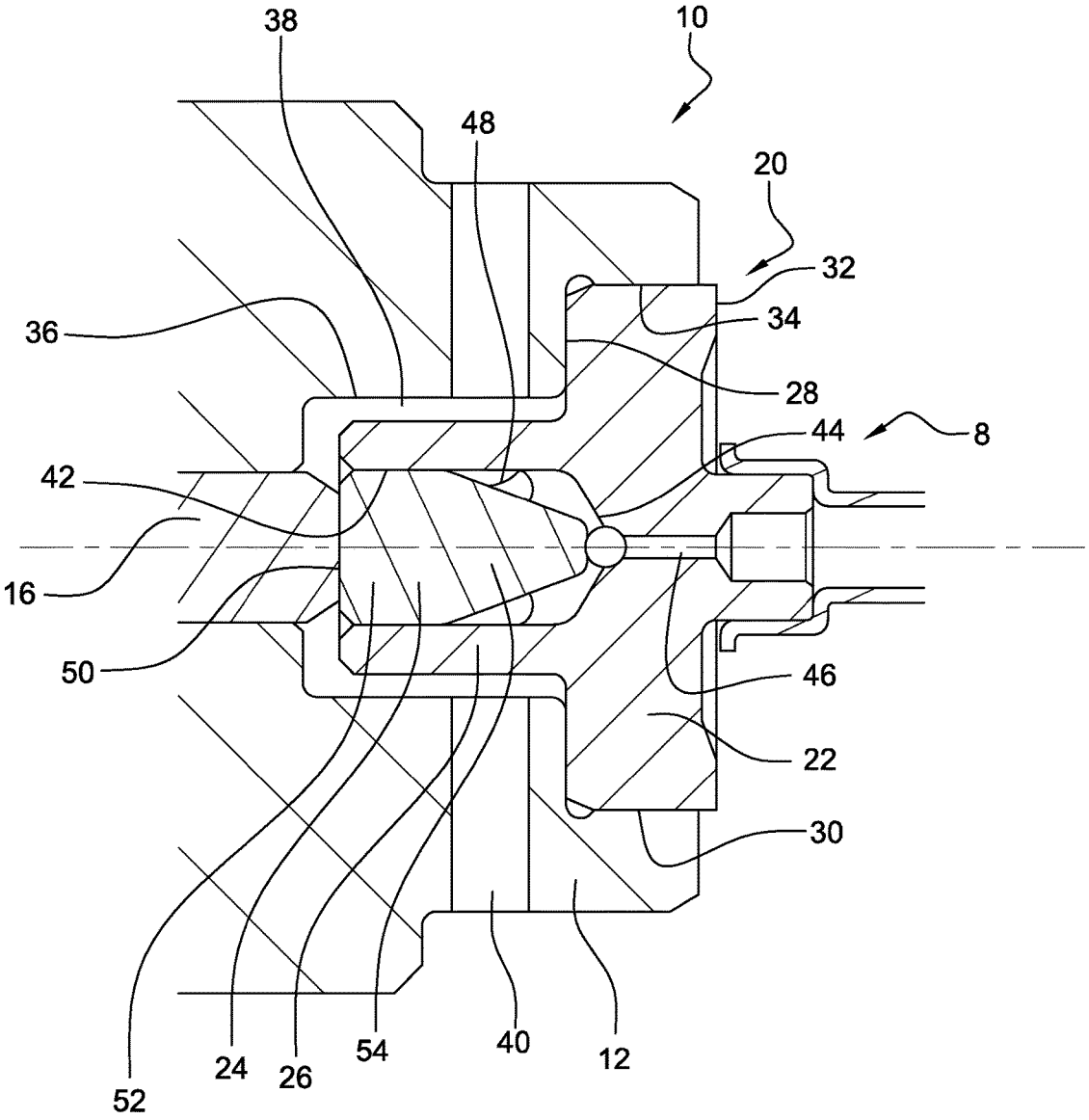
FIG. 4 is an enlarged view of the nozzle of the valve of the preceding figures.

The nozzle 24, detailed in particular in FIG. 4, essentially comprises a fixed member 22 collaborating with a shutoff member 24 that can move.

The fixed member 22 extends axially along a cylindrical tubular part 26, followed by a radial shoulder 28 leading to a larger-diameter cylindrical base 30, the base 30 extending as far as a radial surface 32. The base 30 is arranged in complementary fashion in a counterbore 34. According to the construction of FIG. 1, the counterbore 34 is made in the body 12 and the fixed member 22 is secured to the body 12, the radial shoulder 28 being in abutment against the end of the counterbore 34.

In the alternative construction illustrated in FIG. 2, the complementary counterbore 34 is made in the rail 8. The base 30 fits into the counterbore 34, the radial surface 32 being in abutment with the end of the counterbore 34 so that the fixed member 22 is secured to the rail 8. The radial shoulder 28 for its part is in abutment against the body 12.

The tubular part 26 of the fixed member 22 is arranged in a cylindrical and axial housing 36 of the body 12, an intermediate tubular space 38 thus being created between the fixed member 22 and the body 12. Opening into this space 38 is a transverse discharge duct 40 made in the body 12.

The inside of the tubular part 26 is a guide cylinder 42 ending in a conical surface forming the seat 44 of the nozzle 20. Opening in the center of the seat 44 is a discharge orifice 46 extending axially through the base 30 to reach the rail 8. The wall of the tubular part 26 is provided with at least one connecting orifice 48 connecting the intermediate space 38 to the guide cylinder 42.

Alternatively, the tubular part 26 can be fitted closely into the housing 36 without creating any intermediate space. In this case, the discharge duct 40 provided in the body 12 aligns directly with the connecting orifice 48.

The shutoff member 24 is arranged and guided in the guide cylinder 42. According to the depictions chosen by way of example, it takes the form of the end of a needle extending from a planar radial surface 50 in contact with the shaft 16, as a cylindrical first part 52 of a diameter that forms a sliding fit in the guide cylinder 42, then as a conical second part 54 ending in a point and collaborating with the seat 44 of the nozzle 20.

As an alternative to the needle end described, the shutoff member 24 may have an end piece that is spherical, or conical or some other shape, which likewise collaborates with the seat 44 for the same purpose. The shutoff element 24 may also be a simple ball against which the shaft 16 presses, the ball shutting off the discharge orifice 46. It is also conceivable to interpose between the shutoff element 24 and the seat 44 a ball against which the shutoff element 24 presses, the ball being just large enough in size to shut off the discharge orifice 46.

Once the valve 10 has been assembled, the body 12, the shaft 16, the shutoff element 24, the seat 44 and the discharge orifice 46 are aligned.

In operation, the pressurized fuel flows along the rail 8. Below a pre-established limit pressure L, the electromagnet 14 keeps the shaft in the pressed position PA. The end of the shaft 16 in contact with the radial surface 50 of the shutoff member 24 urges it in such a way that the conical part 54 of the shutoff member 24 is kept in complementary contact with the seat 44 and shuts off the discharge orifice 46. When the pressure of the fuel in the rail 8 exceeds the pre-established limit L, the fuel pushes the shutoff member 24 back by pressing against its conical part 54 and opens the discharge orifice 46. The pressurized fuel can then be discharged passing successively from the rail 8 to the discharge orifice 46 then into the guide cylinder 42, through the connecting orifice 48 into the intermediate space 38 to arrive at the discharge duct 40.

In another embodiment illustrated in FIG. 3, the electromagnet is replaced by an actuating compression spring 56 constantly urging the shaft 16 into the pressed position PA. The spring 56 applies to the shaft 16 a force rated at the pre-established limit pressure L of the fuel in the rail 8. When the pressure in the rail 8 exceeds said limit L it overcomes the force of the spring 56 which compresses slightly allowing the fuel to leave via the discharge orifice 46. When the pressure has dropped back down below the limit pressure L, the force applied by the spring 56 prevails and the discharge orifice 46 is shut off again.

The role of the shaft 16 is limited to that of a push rod pushing the shutoff element 24, and the role of the shutoff element 24 is itself that of shutting off the discharge orifice 46. From the manufacturing standpoint, the machining tolerances are suited to the role played by each component. Thus, the shaft 16 and the axial bore 18 of the body 12 can be produced with, on the one hand, a dimensional tolerance of 30 μm between their respective diameters, whereas previously it had been 12 μm and, on the other hand, having a surface finish of Ra 3.2 whereas previously it had been Ra 1.6. Finally, while the steel for the shutoff member 24 remains a high quality steel, the steel used for the shaft 16 can be more ordinary.

The invention claimed is:

1. A valve for regulating the pressure of the fuel in the common rail of the diesel injection system of a vehicle internal combustion engine, the valve comprising a body, a shaft, an actuator and a nozzle itself comprising a fixed member provided with a nozzle seat in the center of which there opens a discharge orifice connecting the common rail to a discharge duct;

the shaft, arranged axially sliding in a central bore of the body such that the shaft is guided by the central bore, the shaft being moved by the actuator in such a way as to cause the nozzle to switch between the discharge orifice being in an open state (EO) when the pressure in the common rail is above a pre-established limit (L), and the discharge orifice being in a closed state (EF) when the pressure in the common rail is below the pre-established limit (L), characterized in that the valve further comprises a shutoff member arranged between the shaft and the seat so that in the closed state (EF) the shaft pushes the shutoff member into abutment against the seat shutting off the discharge orifice and in the open state (EO) the pressurized fuel pushes the shutoff member back and opens the discharge orifice, the shaft itself being pushed back by the shutoff member, the fixed member of the nozzle comprising a tubular part defining an interior guide cylinder extending axially from an open first end as far as the seat forming the bottom end of the guide cylinder, the shutoff member arranged and guided in the guide cylinder independently of the shaft, the guide cylinder being in fluidic communication with the discharge duct.

2. The valve as claimed in claim 1, in which the tubular part of the fixed member is provided with a connecting orifice connecting the guide cylinder to the discharge duct so that when the nozzle is in the open state (EO), the fuel emerging from the common rail passes in succession through the discharge orifice, the guide cylinder, the connecting orifice and the discharge duct.

3. The valve as claimed in claim 2, in which the body is provided with a housing in which the tubular part is arranged, these between them defining an intermediate tubular space into which the discharge duct and the connecting orifice emerge so that when the nozzle is in the open state (EO) the fuel emerging from the common rail passes through the intermediary tubular space before entering the discharge duct.

4. The valve as claimed in claim 1, in which the fixed member of the nozzle is additionally provided with an axial cylindrical base extending between two radial surfaces so as to position the fixed member by arranging the base in a complementary counterbore, one of the two surfaces being in abutment with the end of the counterbore.

5. The valve as claimed in claim 1, in which the counterbore is provided in the body of the valve, the fixed member of the nozzle being secured to the body.

6. The valve as claimed in claim 1, in which the end of the shutoff member collaborating with the seat has a spherical surface, the seat for its part having a conical surface the vertex of which faces towards the rail.

7. The valve as claimed in claim 1, in which the actuator is the plunger of an electromagnet controlled by a central unit.

8. The valve as claimed in claim 1, in which the actuator is a compression spring constantly urging the shaft with an axial force rated at the pre-established pressure limit (L), so that the shaft urges the nozzle towards the closed state (EF).

9. The valve as claimed in claim 1, in which the dimensional tolerance between the diameters of the axial bore and of the shaft is 30 μm.

10. The valve as claimed in claim 1, in which the axial bore in which the shaft is guided has a surface roughness of less than Ra 3.2.

11. A common rail of a motor vehicle internal combustion engine diesel injection system comprising amongst other things a counterbore capable of accepting a nozzle arranged in a valve produced as claimed in claim 1, the base fitting into the counterbore, the fixed member being secured to the common rail.

12. A diesel fuel injection system of the common rail type comprising a valve produced as claimed in claim 1.

13. The injection system as claimed in claim 12, comprising a common rail produced as claimed in claim 11.

* * * * *